US010775716B2

(12) United States Patent
Akaike et al.

(10) Patent No.: US 10,775,716 B2
(45) Date of Patent: Sep. 15, 2020

(54) IMAGE FORMING UNIT AND IMAGE FORMING APPARATUS

(71) Applicant: FUJI XEROX CO., LTD., Tokyo (JP)

(72) Inventors: Takashi Akaike, Kanagawa (JP); Shota Makita, Kanagawa (JP); Yosuke Kuwata, Kanagawa (JP); Takafumi Wakai, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/517,855

(22) Filed: Jul. 22, 2019

(65) Prior Publication Data

US 2020/0257221 A1 Aug. 13, 2020

(30) Foreign Application Priority Data

Feb. 13, 2019 (JP) ..... 2019-023104

(51) Int. Cl.
*G03G 15/08* (2006.01)
*G03G 21/20* (2006.01)
*G03G 15/00* (2006.01)

(52) U.S. Cl.
CPC ..... *G03G 15/0889* (2013.01); *G03G 15/0865* (2013.01); *G03G 15/0881* (2013.01); (Continued)

(58) Field of Classification Search
CPC ..... G03G 15/0889; G03G 15/0865; G03G 15/0881; G03G 15/0896; G03G 15/0898; (Continued)

(56) References Cited

U.S. PATENT DOCUMENTS

2005/0095028 A1* 5/2005 Lee ..... G03G 15/0898 399/98
2011/0229184 A1* 9/2011 Kashimoto ..... G03G 15/0896 399/92

(Continued)

FOREIGN PATENT DOCUMENTS

JP 59220773 A * 12/1984 ..... G03G 15/0898
JP 2015-079134 A 4/2015

*Primary Examiner* — Ryan D Walsh
(74) *Attorney, Agent, or Firm* — Sughrue Mion, PLLC

(57) ABSTRACT

An image forming unit includes an image carrier, a developer carrier, a development housing, and a guide member. The image carrier forms an electrostatic latent image. The developer carrier is in contact with the image carrier while rotating about a rotation axis and facing the image carrier to develop the electrostatic latent image. The development housing accommodates a developer and rotatably supports the developer carrier at one end with an opening portion that is open to the image carrier. The development housing includes an agitation path in which the developer is agitated and a feed path through which the developer is fed to the developer carrier. The guide member is disposed below the opening portion and includes an inner surface opposing the development housing to form a flow path that guides a current of air produced with rotation of the developer carrier in a direction away from the developer carrier, and to guide a recording medium to the image carrier with an outer surface opposite to the inner surface. Dust contained in the current of air is deposited on the inner surface of the guide member.

20 Claims, 11 Drawing Sheets

(52) U.S. Cl.
CPC ..... *G03G 15/0896* (2013.01); *G03G 15/0898* (2013.01); *G03G 15/6555* (2013.01); *G03G 21/206* (2013.01); *G03G 2215/0872* (2013.01)

(58) Field of Classification Search
CPC ..... G03G 15/6555; G03G 21/206; G03G 2215/0872
See application file for complete search history.

(56) References Cited

U.S. PATENT DOCUMENTS

2012/0251155 A1* 10/2012 Ishikawa ..... G03G 15/0806 399/92
2015/0110518 A1* 4/2015 Nagamori ..... G03G 21/206 399/92

* cited by examiner

IMAGE FORMING UNIT AND IMAGE FORMING APPARATUS

CROSS-REFERENCE to RELATED APPLICATIONS

This application is based on and claims priority under 35 USC 119 from Japanese Patent Application No. 2019-023104 filed Feb. 13, 2019.

BACKGROUND

(i) Technical Field

The present disclosure relates to an image forming unit and an image forming apparatus.

(ii) Related Art

Known is an image forming unit that includes a developing member that develops an electrostatic latent image on a rotating image carrier, a container member that accommodates a developing member and includes an end portion opposing the image carrier at a portion downstream of the developing member in a direction in which the image carrier moves, and a guide member that guides a recording medium to the image carrier and that opposes the end portion at a portion downstream of the container member in the direction in which the image carrier moves. The image forming unit has a flow path between the end portion of the container member and the guide member. The flow path guides a current of air caused by rotation of the image carrier in a direction away from the image carrier (Japanese Patent Application Publication No. 2015-079134).

SUMMARY

Aspects of non-limiting embodiments of the present disclosure relate to an image forming unit that keeps floating toner produced therein within itself to prevent the floating toner from intruding into an image forming apparatus.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming unit that includes an image carrier that forms an electrostatic latent image, a developer carrier that is in contact with the image carrier while rotating about a rotation axis and facing the image carrier to develop the electrostatic latent image, a development housing that accommodates a developer and that rotatably supports the developer carrier at one end with an opening portion that is open to the image carrier, the development housing including an agitation path in which the developer is agitated and a feed path through which the developer is fed to the developer carrier, and a guide member disposed below the opening portion and including an inner surface opposing the development housing to form a flow path that guides a current of air produced with rotation of the developer carrier in a direction away from the developer carrier, and to guide a recording medium to the image carrier with an outer surface opposite to the inner surface. Dust contained in the current of air is deposited on the inner surface of the guide member.

BRIEF DESCRIPTION OF THE DRAWINGS

Exemplary embodiments of the present disclosure will be described in detail based on the following figures, wherein.

DETAILED DESCRIPTION

Figure 1:
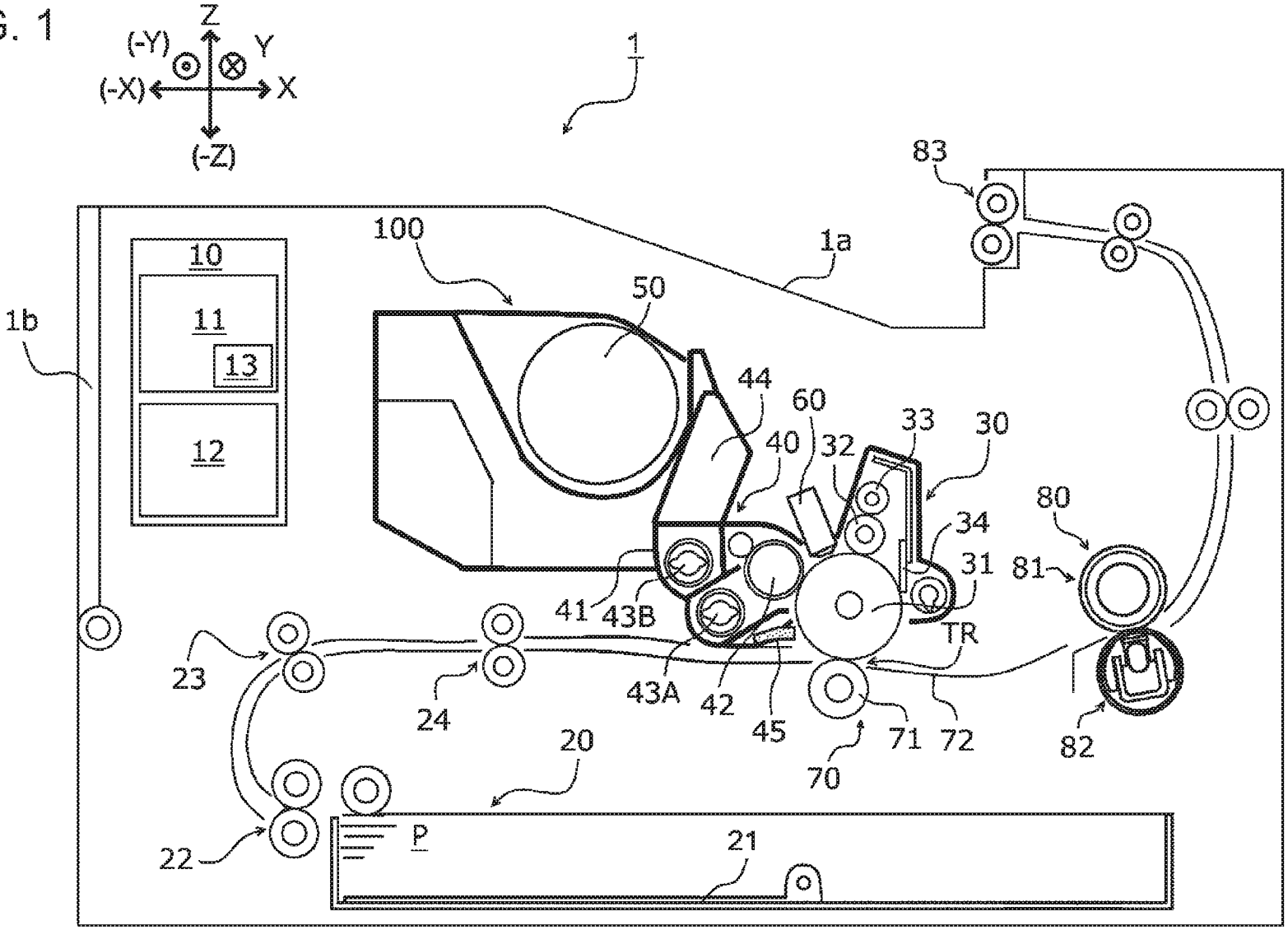
FIG. 1 is a schematic cross-sectional view of an internal structure of an image forming apparatus according to an exemplary embodiment.

Exemplary embodiments and specific examples are described below with reference to the drawings to describe the disclosure in further detail. The disclosure, however, is not limited to these exemplary embodiments and specific examples.

In the following description with reference to the drawings, the drawings are schematic, and the ratios between the dimensions or other details differ from the actual ones. For easy understanding, components other than those needed for the description are omitted, as appropriate.

For easy understanding of the following description, in the drawings, the lateral direction of an image forming apparatus 1 is referred to as a X axis direction, the depth direction of the image forming apparatus 1 is referred to as a Y axis direction, and the vertical direction of the image forming apparatus 1 is referred to as a Z axis direction.

(1) Entire Structure and Operation of Image Forming Apparatus

FIG. 1 is a schematic, vertically sectional view of the internal structure of the image forming apparatus 1 according to an exemplary embodiment.

The entire structure and an operation of the image forming apparatus 1 will be described below, with reference to the drawings.

The image forming apparatus 1 includes a controlling device 10, a sheet transport device 20, an image forming unit 100 including an integrated unit of a photoconductor unit 30 and a developing device 40, a toner cartridge 50, an exposure device 60, a transfer device 70, and a fixing device 80.

The controlling device 10 includes an image forming apparatus controller 11, which controls the operation of the image forming apparatus 1, a controller unit 12, which prepares image data corresponding to a printing request, an exposure controller 13, which controls lighting of a light source of the exposure device 60, and a power supply device (not illustrated). The power supply device applies predetermined voltages to components such as a charging roller 32, a development roller 42, and a transfer roller 71, which are described later, and feeds power to the exposure device 60.

The controller unit 12 converts, to image information for forming latent images, image data input from an image reading device (not illustrated) or print information input from an external-information transmitting device (such as a personal computer), and outputs a driving signal to the exposure controller 13 at predetermined timing. The exposure controller 13 drives the exposure device 60 to scan the surface of a photoconductor drum 31 with light modulated in accordance with the formed image data.

The exposure device 60 according to the present exemplary embodiment includes an LED head including light emitting diodes (LEDs) arranged in a line.

The sheet transport device 20 is disposed at a bottom portion of the image forming apparatus 1. The sheet transport device 20 includes a paper cassette 21, and a large number of sheets P are stacked on the upper surface of the paper cassette 21. The sheets P having the widthwise positions fixed by a regulation board are drawn out backward (in the X direction) one by one from the top by a sheet drawing portion 22, and then transported to a contact portion of a pair of registration rollers 24 via relay rollers 23.

The photoconductor unit 30 is disposed above the sheet transport device 20 and includes the photoconductor drum 31 that is driven to rotate. The charging roller 32, the developing device 40, the transfer roller 71, and a cleaning blade 34 are disposed in the rotation direction of the photoconductor drum 31. A cleaning roller 33, which cleans the surface of the charging roller 32, opposes the charging roller 32 in contact with the charging roller 32.

The developing device 40 includes a development housing 41, which accommodates a developer. The development housing 41 accommodates a development roller 42, disposed to oppose the photoconductor drum 31, and a pair of a feed auger 43A and an agitation auger 43B, disposed on the back side of and obliquely below the development roller 42. The feed auger 43A and the agitation auger 43B feed the developer toward the development roller 42 while agitating the developer. Above the developing device 40, a developer containing portion 44, which accommodates a developer, is disposed. Before being attached to the image forming apparatus 1, the developer containing portion 44 is divided by a seal member (not illustrated) from the development housing 41, so that the developer is retained in the developer containing portion 44.

Below the development housing 41, an upper guide chute 45, which is an example of a guide member, is disposed. The upper guide chute 45 guides a sheet P registered by the pair of registration rollers 24 to a transfer portion TR. The toner cartridge 50 is disposed above the developing device 40 while being supported by the image forming unit 100. The toner cartridge 50 accommodates toner (not illustrated), and feeds the toner to the developing device 40 as needed.

The surface of the rotating photoconductor drum 31 is charged by the charging roller 32 and on which an electrostatic latent image is formed by the exposure device 60. An electrostatic latent image formed on the photoconductor drum 31 is developed by the development roller 42 into a toner image.

The transfer device 70 includes the transfer roller 71 and a transport guide 72. The transfer roller 71 receives a predetermined transfer voltage from the power supply device controlled by the image forming apparatus controller 11 to transfer the toner image on the photoconductor drum 31 to a sheet P that passes through a gap between the photoconductor drum 31 and the transfer roller 71.

The remaining toner on the surface of the photoconductor drum 31 is removed by the cleaning blade 34, and reclaimed into a waste toner box (not illustrated). Thereafter, the surface of the photoconductor drum 31 is recharged by the charging roller 32. Remnants adhering to the charging roller 32 without being removed by the cleaning blade 34 are captured by the surface of the cleaning roller 33 rotating in contact with the charging roller 32, and then discharged again onto the photoconductor drum 31 via the charging roller 32.

The fixing device 80 includes a pair of a heating module 81 and a pressing module 82. The area over which the heating module 81 and the pressing module 82 are in pressure contact with each other forms a fixing nip portion (fixing area).

The sheet P to which a toner image has been transferred by the transfer roller 71 is transported to the fixing device 80 via the transport guide 72 while having the toner image unfixed.

The sheet P transported to the fixing device 80 has the toner image fixed by the heating module 81 and the pressing module 82 with heat and pressure. The sheet P carrying the fixed toner image is discharged to a paper output tray 1*a* on the upper surface of the image forming apparatus 1 through a pair of discharging rollers 83.

(2) Structure of Related Portion

Figure 2:
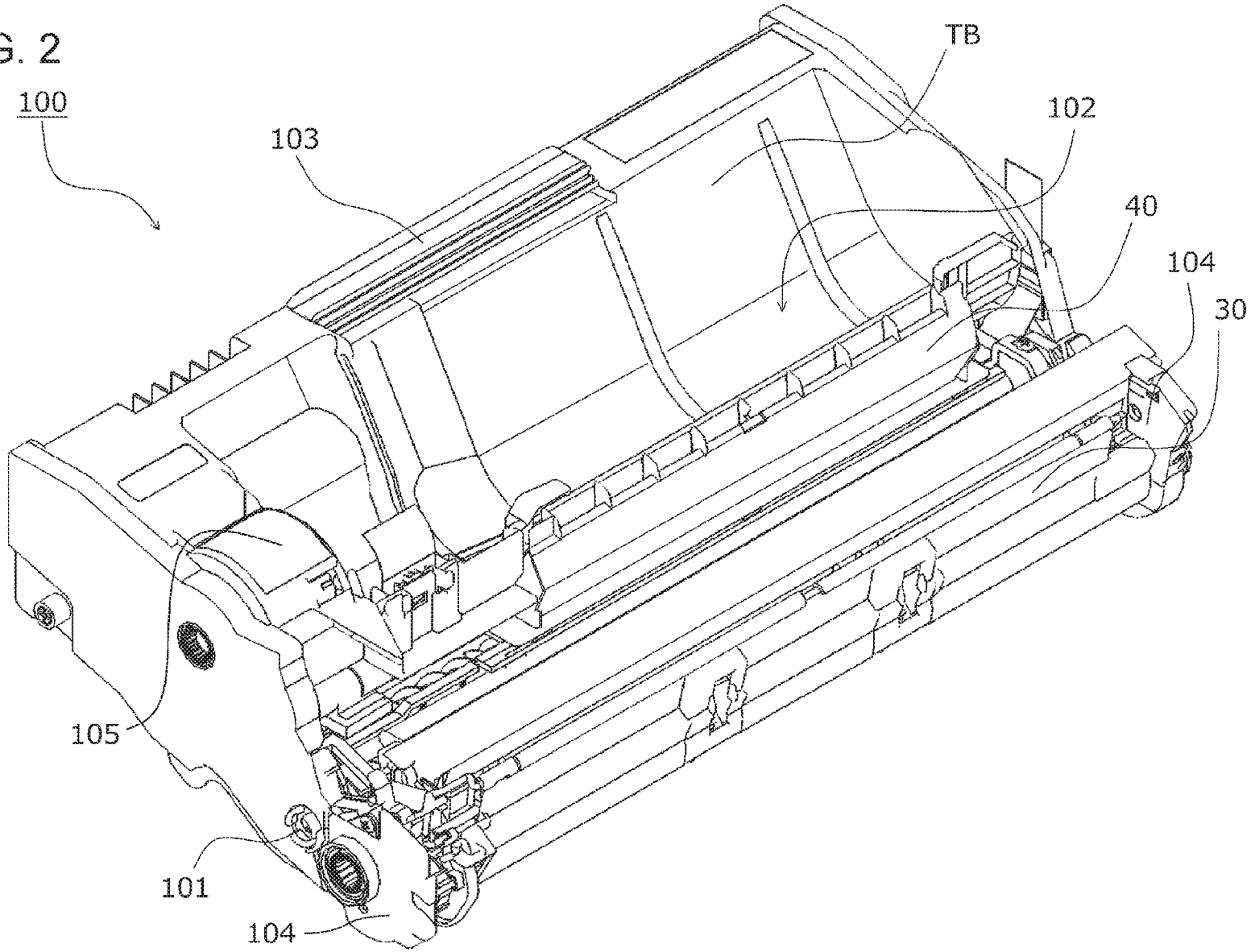
FIG. 2 is a perspective view of the entire structure of an image forming unit.
Figure 3:
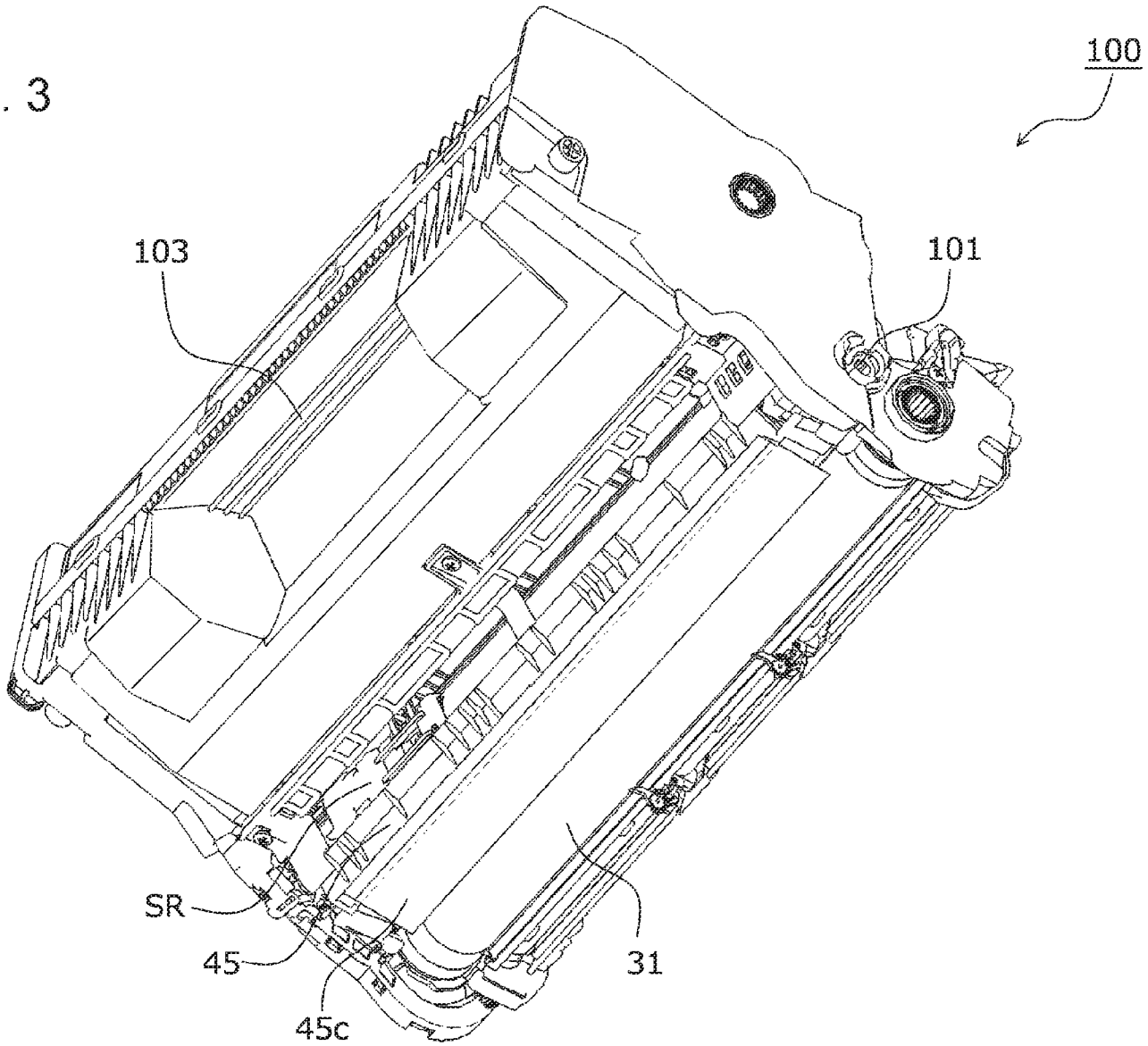
FIG. 3 is a perspective view of an undersurface of the image forming unit.
Figure 4:
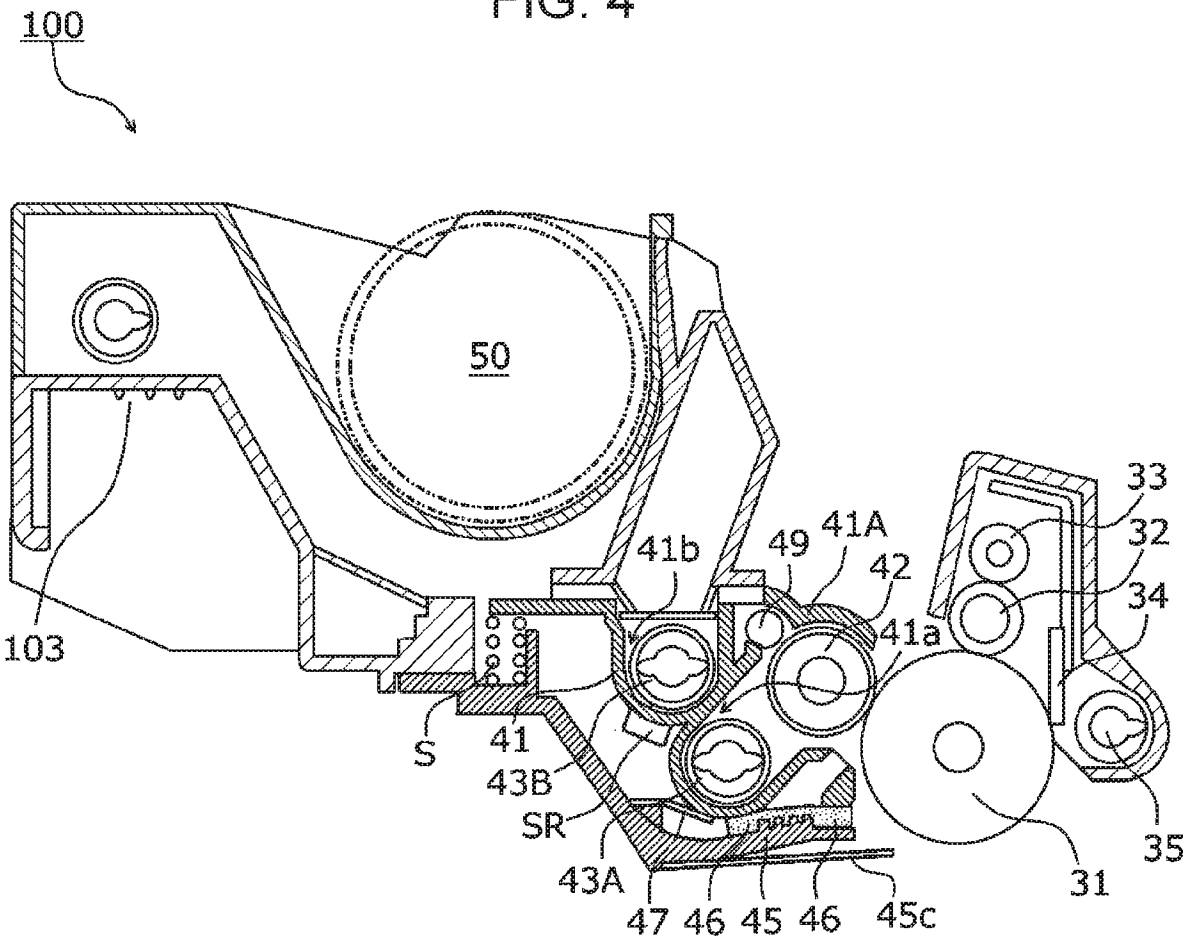
FIG. 4 is a schematic cross-sectional view of a structure of the image forming unit.
Figure 5:
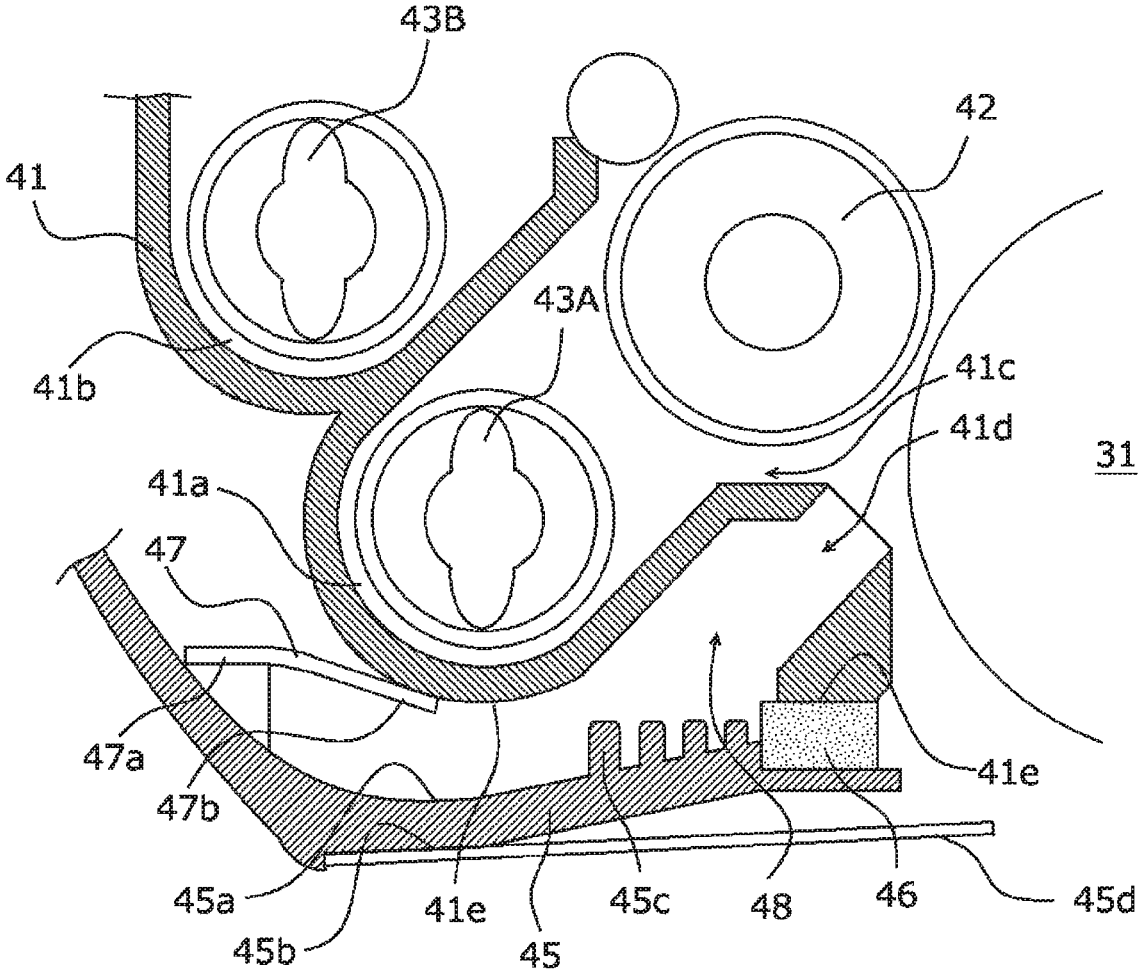
FIG. 5 is an enlarged schematic cross-sectional view of a flow path in a developing device.
Figure 6:
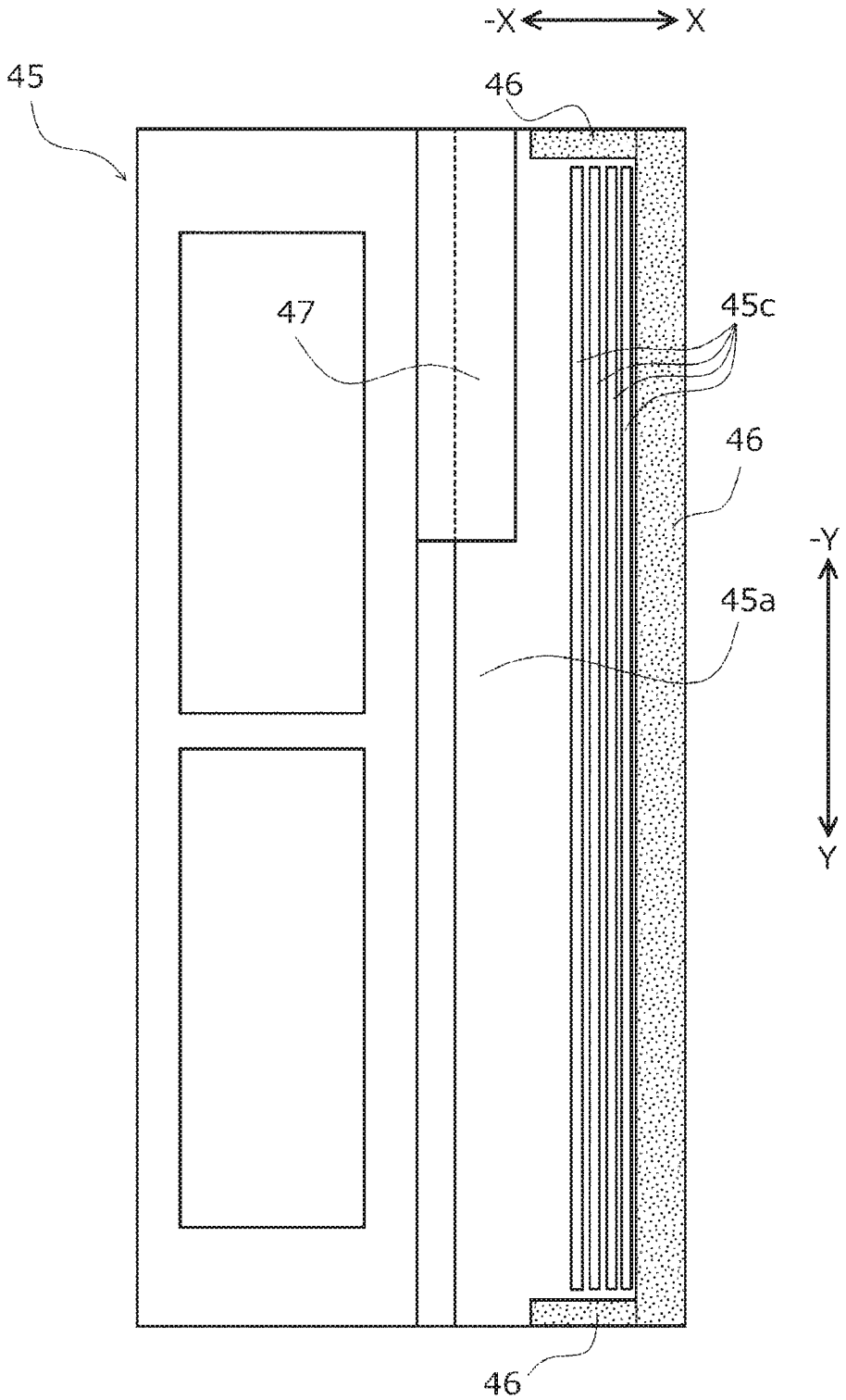
FIG. 6 is a schematic plan view of a flow path in a developing device.
Figure 7:
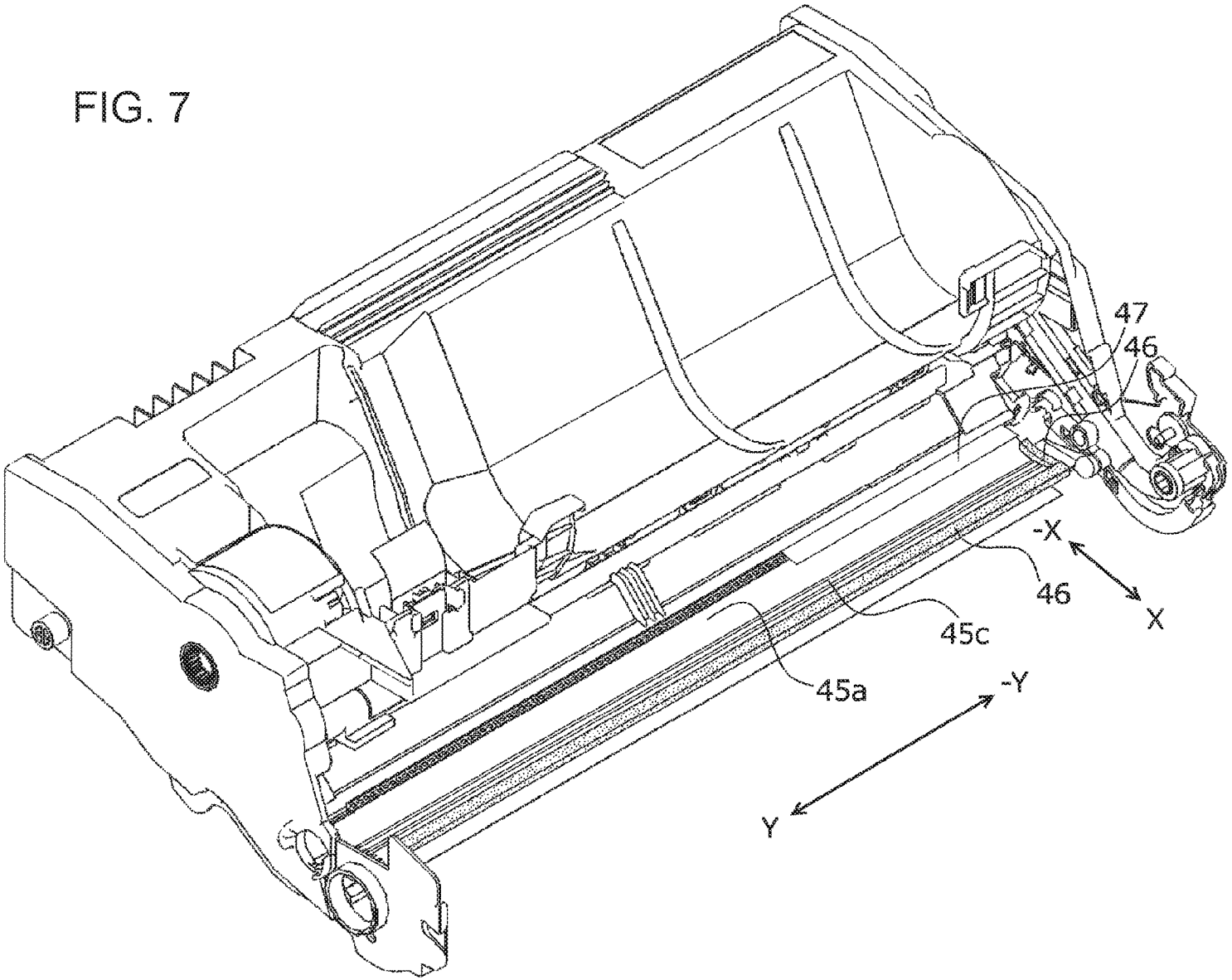
FIG. 7 is a perspective view of a flow path in the developing device without illustrating a photoconductor unit and the developing device.
Figure 8:
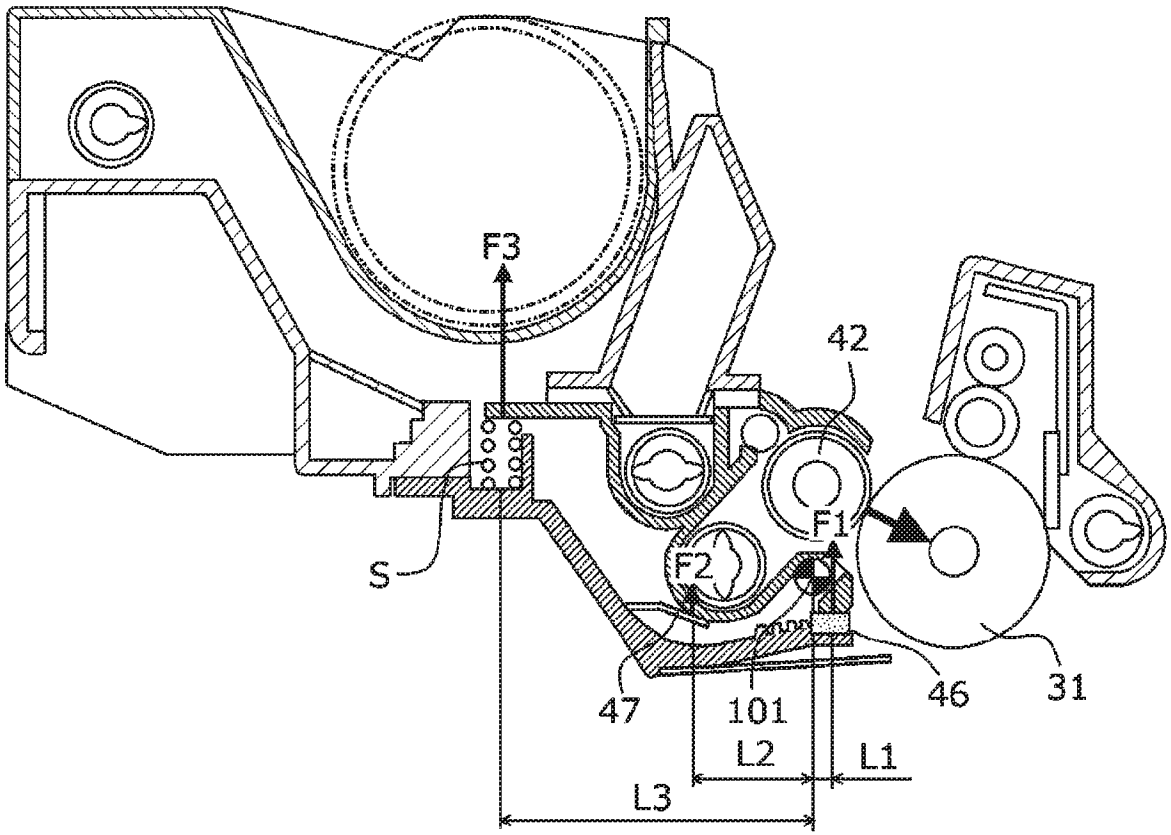
FIG. 8 is a schematic cross-sectional view of a moment around a pivot shaft in the developing device.

FIG. 2 is a perspective view of the entire structure of the image forming unit 100, FIG. 3 is a perspective view of an undersurface of the image forming unit 100, FIG. 4 is a schematic cross-sectional view of a structure of the image forming unit 100, FIG. 5 is an enlarged schematic cross-sectional view of a flow path 48 in the developing device 40, FIG. 6 is a schematic plan view of the flow path 48 in the developing device 40, FIG. 7 is a perspective view of the flow path 48 of the developing device 40 without illustrating the photoconductor unit 30 and the developing device 40, and FIG. 8 is a schematic cross-sectional view of a moment around a pivot shaft 101 in the developing device 40.

Now, the structure of the developing device 40 and the air flow path 48 in the developing device 40 will be described with reference to the drawings.

(2.1) Entire Structure of Image Forming Unit

The image forming unit 100 includes the photoconductor unit 30, the developing device 40, and a waste toner reclaim container TB, which are formed as an integrated unit, and is attachable to and removable from the image forming apparatus 1 when an open-close cover 1*b* (refer to FIG. 1) of the image forming apparatus 1 is open.

The photoconductor unit 30 and the developing device 40 are coupled together with the pivot shaft (refer to FIG. 2 and FIG. 8) 101, serving as a rotation shaft. When the development housing 41 of the developing device 40 is pressed by a pressing spring S (refer to FIG. 4), the photoconductor unit 30 and the developing device 40 rotate about the pivot shaft 101, and the development roller 42 and the photoconductor drum 31 come into contact with each other with a contact roller (not illustrated) interposed therebetween to have a predetermined gap held between each other.

The toner cartridge 50 is attached to an upper recess 102 of the image forming unit 100, and feeds toner mixed with a developer by a toner feeding mechanism 105 into the development housing 41 of the developing device 40.

The remaining toner on the photoconductor drum 31 removed by the cleaning blade 34 is transported into the waste toner reclaim container TB by a transport auger 35 and a transport coil auger (not illustrated) to be reclaimed.

(2.2) Structure of Photoconductor Unit

As illustrated in FIG. 4, the photoconductor drum 31 of the photoconductor unit 30 is rotatably supported by an image forming unit housing 104. Besides the photoconductor drum 31, the photoconductor unit 30 includes a unit of the charging roller 32, the cleaning roller 33, the cleaning blade 34, and the transport auger 35, which transports toner removed by the cleaning blade 34 into the waste toner reclaim container TB.

(2.3) Structure of Developing Device

As illustrated in FIG. 4, in the developing device 40, the development roller 42 is rotatably supported by the development housing 41. The development housing 41 defines a feed path 41*a*, through which the developer is fed to the development roller 42 with rotation of the feed auger 43A, and an agitation path 41*b*, through which the developer is transported toward one end of the feed path 41*a* with rotation of the agitation auger 43B while the developer is agitated.

A developer G to which toner fed from the toner cartridge 50 is mixed is transported from the near side (outer side or the Y side) to the far side (inner side or the −Y side) while being agitated by the agitation auger 43B, and moved to the feed auger 43A on the far side (inner side or the −Y side). The developer fed from the feed auger 43A is then fed to the development roller 42.

An ATC sensor SR is installed on the developing device 40. The ATC sensor SR serves as a developer detection member that measures a ratio (TC value) of toner to a carrier in the developer circulating in the development housing 41. The TC value of the developer is retained at a predetermined value by the image forming apparatus controller 11 of the image forming apparatus 1 instructing feeding of toner from the toner cartridge 50 on the basis of a measurement value from the ATC sensor SR.

The feed path 41*a* and the agitation path 41*b* in the development housing 41 are filled with the developer fed from the developer containing portion 44, and covered with a covering member 41A.

A layer regulation member 49 is disposed above a feed path 41*a* near the development roller 42 to regulate the thickness of a developer layer adhering to the development roller 42 with a magnetic force.

As illustrated in FIG. 5 in detail, an opening 41*d* is formed below (on the −Z side of) an opening portion 41*c*, in which the development roller 42 of the development housing 41 is rotatably supported, to extend in the widthwise direction (Y direction) of the development housing 41. The opening 41*d* is open to the opposing surfaces of the development roller 42 and the photoconductor drum 31.

The upper guide chute 45 is disposed below (on the −Z side of) the opening portion 41*c*. The upper guide chute 45 has its inner surface 45*a* facing an outer surface 41*e* of the development housing 41. A guide plate 45*d* is attached to an outer surface 45*b* of the upper guide chute 45 opposite to the inner surface 45*a*. The guide plate 45*d* guides a sheet P transported after being registered by the pair of registration rollers 24 to a transfer portion TR, nipped by the photoconductor drum 31 and the transfer roller 71.

An elastic body 46 made of a polyurethane sponge, which is a polyurethane foam, is attached to the outer surface 41*e* of the opening portion 41*c* of the development housing 41 opposing the inner surface 45*a* of the upper guide chute 45.

As illustrated in FIG. 6, the elastic body 46 is attached to an area along the opening 41*d* extending in the widthwise direction (Y direction) of the development housing 41 and an area on both sides of the area in the sheet transport direction (X direction) to form an angular C shape. The elastic body 46 is compressed between the development housing 41 and the inner surface 45*a* of the upper guide chute 45. As illustrated in FIG. 6, the elastic body 46 may be attached to the inner surface 45*a* of the upper guide chute 45.

As illustrated in FIG. 5, the opening 41*d*, the outer surface 41*e* of the development housing 41, and the inner surface 45*a* of the upper guide chute 45 form part of the flow path 48, which guides a current of air produced by rotation of the development roller 42 in a direction away from the development roller 42 (in the −X direction) at uniform airtightness.

A film member 47 made of a polyurethane film with a thickness of 0.2 to 0.3 mm is attached to the inner surface 45*a* of the upper guide chute 45 at a portion away from the development roller 42 (in the −X direction). As illustrated in FIG. 5, the film member 47 has its base end 47a attached to the inner surface 45*a* of the upper guide chute 45, and its free end 47*b* in contact with the outer surface 41*e* of the development housing 41. As illustrated in FIG. 6, the film member 47 is attached over a certain amount of area (in the Y direction) on the downstream side (inner side) of the feed path 41*a* in the developer transport direction to extend in the widthwise direction of the developing device 40.

Thus, a certain amount of area of the flow path 48 on the upstream side (inner side) of the feed path 41*a* in the developer transport direction extends in the axial direction (Y direction) of the development roller 42 to serve as a space sealed and defined by the elastic body 46 and the film member 47, the entire area of the flow path 48 along the opening 41*d* on the downstream side (outer side) of the feed path 41*a* in the developer transport direction is sealed with the elastic body 46, and the side (−X side) away from the development roller 42 is open to the outside.

As illustrated in FIG. 7, the outer surface 41*e* of the development housing 41 and the inner surface 45*a* of the upper guide chute 45 define a space below the opening portion 41*c* of the development housing 41, the entire portion on the side closer to the development roller 42 is sealed with the elastic body 46, and a partial portion on the side away from the development roller 42 is sealed with the free end 47*b* of the film member 47 in contact with the development housing 41. Thus, the flow path 48 is formed over the inner surface 45*a* of the upper guide chute 45 of the developing device 40.

As illustrated in FIG. 8, when the flow path 48 is viewed with reference to the pivot shaft 101 to which the photoconductor unit 30 and the developing device 40 are coupled together, the area closer to the pivot shaft 101 is sealed with the elastic body 46 compressed between the development housing 41 and the inner surface 45*a* of the upper guide chute 45, and the area away from the pivot shaft 101 (on the −X side) is sealed with the film member 47 having its free end 47*b* in contact with the development housing 41, the film member 47 having its base end 47*a* attached to the inner surface 45*a* of the upper guide chute 45.

In the flow path 48 thus hermetically sealed, a distance L2 between the pivot shaft 101 and the contact position of the free end 47*b* of the film member 47 is longer than a distance L1 between the pressure contact position of the elastic body 46 and the pivot shaft 101. However, a contact force F2 of the film member 47 is far smaller than a pressure contact load F1 of the elastic body 46. Thus, a moment exerted on the photoconductor drum 31 when the development roller 42 comes into contact with the photoconductor drum 31 with rotation about the pivot shaft 101 negligibly increases, so that an increase of the load borne by the photoconductor drum 31 is reduced.

(3) Operation of Flow Path

Figure 9:
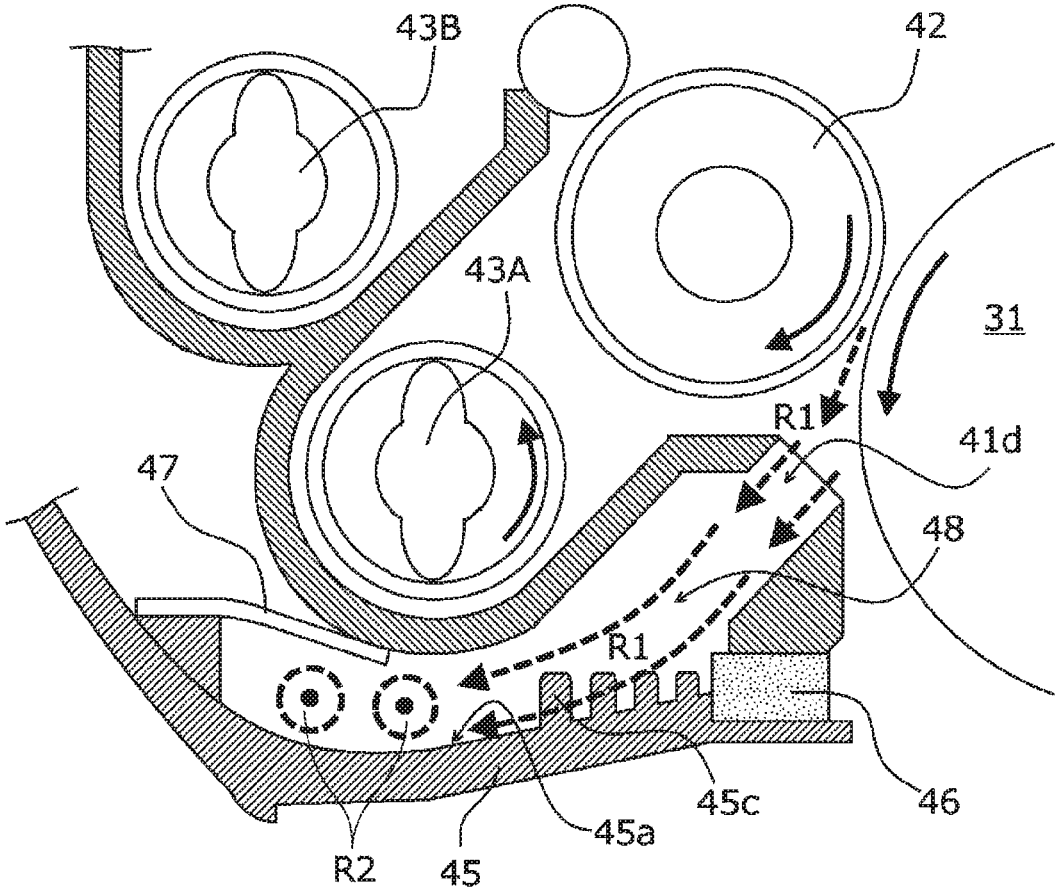
FIG. 9 is a schematic cross-sectional view of a current of air around a photoconductor drum and a development roller of the image forming unit.
Figure 10:
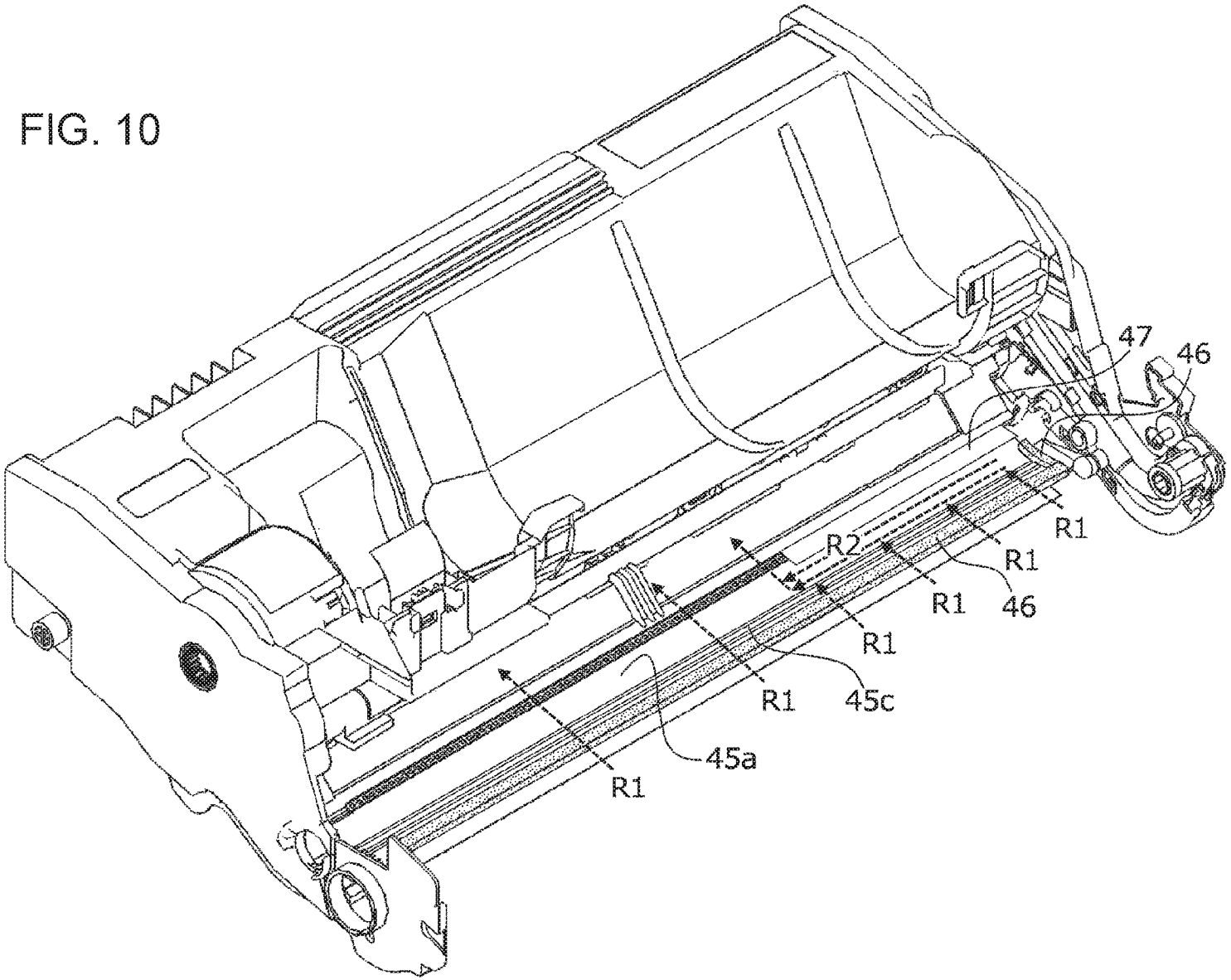
FIG. 10 is a perspective view of a current of air in a flow path without illustrating the developing device and the photoconductor unit.
Figure 11:
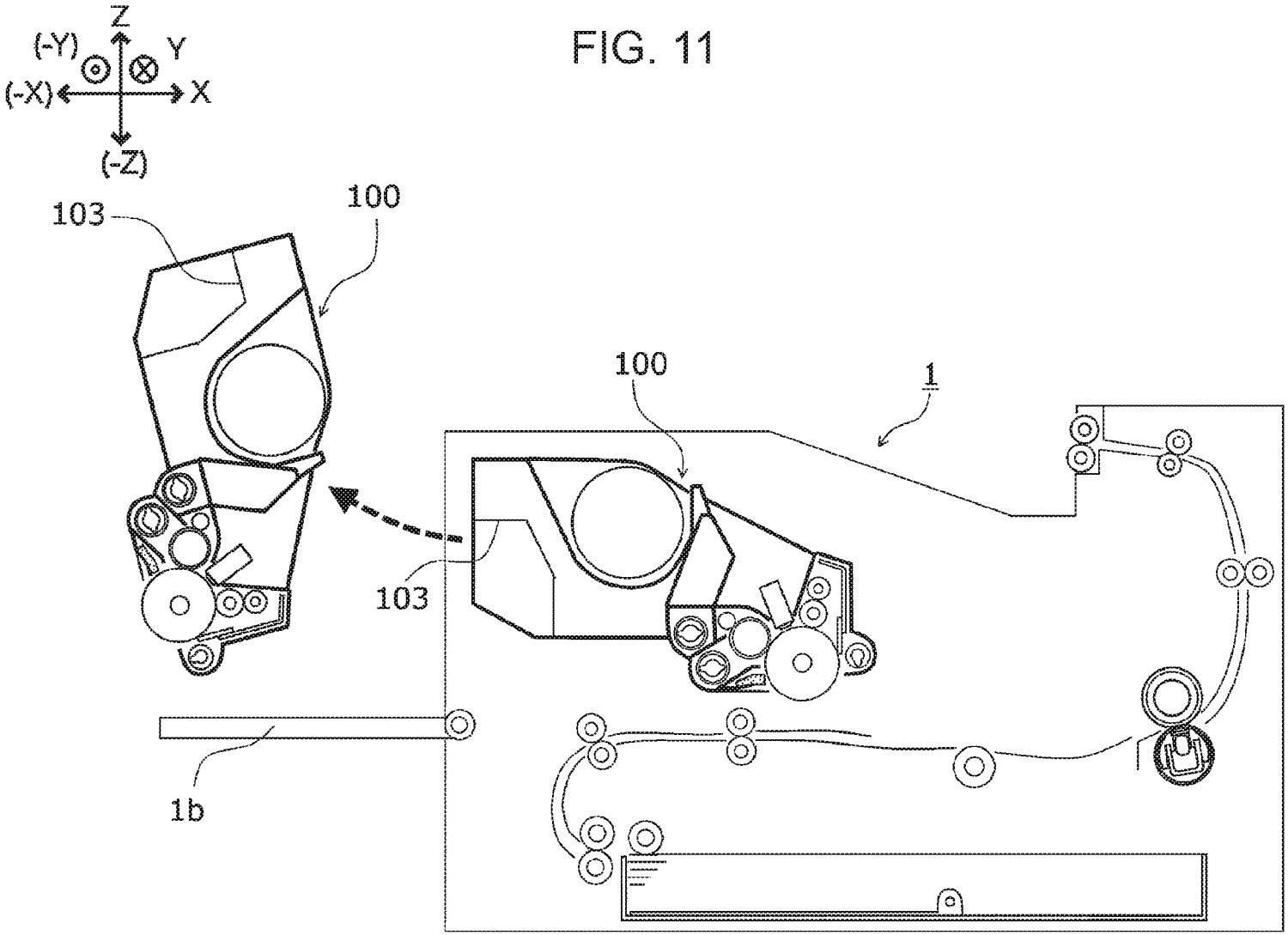
FIG. 11 illustrates an operation of removing the image forming unit of an image forming apparatus.

FIG. 9 is a schematic cross-sectional view of a current of air around the photoconductor drum 31 and the development roller 42 of the image forming unit 100. FIG. 10 is a perspective view of a current of air in the flow path 48 without illustrating the developing device 40 and the photoconductor unit 30. FIG. 11 illustrates an operation of removing the image forming unit 100 in the image forming apparatus 1.

When the image forming unit 100 develops an electrostatic latent image formed on the surface of the photoconductor drum 31, a floating toner (referred to as cloud toner, below) may be produced in the developing device 40.

Specifically, in the developing device 40, toner may rise in the development housing 41 when, for example, toner is agitated by the feed auger 43A or the agitation auger 43B, or insufficiently charged toner is additionally fed to the development housing 41, so that cloud toner may be produced in the development housing 41.

Here, in the developing device 40, a current of air that flows into the development housing 41 occurs as a result of, for example, rotation of the feed auger 43A, the agitation auger 43B, or the development roller 42. Thus, the inside of the development housing 41 has a higher pressure than the outside of the development housing 41. Thus, cloud toner may leak together with air from the inside of the development housing 41 of the developing device 40, and may waft around the developing device 40. Particularly, cloud toner frequently occurs on the upstream side of the feed path 41*a* of the development housing 41 in the developer transport direction, which is arranged on the side of the downstream side of the agitation path 41*b* in the developer transport direction.

When cloud toner leaks out around the developing device 40 and arrives at the transport path of the sheet P beyond the upper guide chute 45, the toner may adhere to the sheet P to stain the sheet P.

When the image forming unit 100 is removed from the image forming apparatus 1 for replacement while toner is adhering to the outer surface 45*b* of the upper guide chute 45, the adhering toner may fall into the image forming apparatus 1, adhere to, for example, hands of a user that replaces the image forming unit 100, or fall on, for example, clothes of a user to stain the clothes.

In the image forming unit 100 according to the present exemplary embodiment, the opening 41*d*, which is open to the opposing surfaces of the development roller 42 and the photoconductor drum 31, is formed below the opening portion 41*c* of the development housing 41 to extend in the widthwise direction (Y direction) of the development housing 41. The flow path 48 is continuous with the opening 41*d* to extend toward the upstream side in the sheet transport direction and away from the development roller 42. Thus, a current of air R1 produced by rotation of the development roller 42 and the photoconductor drum 31 flows through the opening 41*d* into the flow path 48.

As illustrated in FIG. 9, on the inner surface 45*a* of the upper guide chute 45 forming a lower wall of the flow path 48, multiple ribs 45*c* extend in the axial direction of the development roller 42 to protrude in a direction crossing the direction in which the current of air R1 flows. The ribs 45*c* have gradually higher heights from the one on the upstream side to the one on the downstream side in the direction in which the current of air R1 flows. Thus, the surface area in the flow path 48 is increased to keep a larger amount of cloud toner in the flow path 48.

As illustrated in FIG. 10, a certain amount of area of the flow path 48 on the upstream side of the feed path 41*a* in the developer transport direction on the downstream side of the flow path 48 in a direction in which the current of air R1 flows extends in the axial direction of the development roller 42 to serve as a space sealed with and defined by the film member 47, and the area on the downstream side of the feed path 41*a* in the developer transport direction is open to the outside.

Thus, a current of air (current of air R2) flows in the space sealed with and defined by the film member 47 from the upstream side of the feed path 41*a* to the downstream side of the feed path 41*a* in the developer transport direction. This structure guides, in the axial direction of the development roller 42, floating toner in the area on the upstream side of the feed path 41*a* in the developer transport direction in which the floating toner is particularly more likely to occur to keep cloud toner produced in the image forming unit 100 within the image forming unit 100.

The ATC sensor SR is disposed on the upstream side of the feed path 41*a* in the developer transport direction. The current of air (current of air R2) flows through the space sealed with and defined by the film member 47 from the upstream side of the feed path 41*a* to the downstream side of the feed path 41*a* in the developer transport direction.

Thus, the cloud toner is prevented from adhering to the ATC sensor SR.

In the image forming unit 100 according to the present exemplary embodiment, a handle 103 held for attachment or removal is disposed at a position away from the photoconductor drum 31 and most upstream in a direction in which the sheet P is guided. Thus, as illustrated in FIG. 11, when the image forming unit 100 is removed from the image forming apparatus 1 so as to hang down, cloud toner reclaimed into the flow path 48 is prevented from falling from the image forming unit 100 with the elastic body 46 attached to the flow path 48 in an angular C shape in the widthwise direction (Y direction) of the development housing 41 (refer to FIG. 6 and FIG. 7).

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming unit, comprising:

an image carrier that forms an electrostatic latent image;

a developer carrier that is in contact with the image carrier while rotating about a rotation axis and facing the image carrier to develop the electrostatic latent image;

a development housing that accommodates a developer and that rotatably supports the developer carrier at one end with an opening portion that is open to the image carrier, the development housing including an agitation path in which the developer is agitated and a feed path through which the developer is fed to the developer carrier; and a guide member disposed below the opening portion and including an inner surface opposing the development housing to form a flow path that guides a current of air produced with rotation of the developer carrier in a direction away from the developer carrier, and to guide a recording medium to the image carrier with an outer surface opposite to the inner surface, wherein dust contained in the current of air is deposited on the inner surface of the guide member, and an area of the flow path further from the rotation axis is sealed with a film member having a free end in contact with the development housing and having a base end attached to the inner surface of the guide member.

2. The image forming unit according to claim 1, wherein an area of the flow path adjacent to the rotation axis in a direction in which the recording medium is guided is sealed with an elastic body compressed between the development housing and the inner surface.

3. The image forming unit according to claim 2, wherein the flow path extends in an axial direction of the developer carrier, an area of the flow path on an upstream side in a direction in which the developer is transported is sealed with the elastic body and the film member, and an area of the flow path on a downstream side is continuous to an outside with the area further from the rotation axis being open.

4. The image forming unit according to claim 3, wherein a plurality of ribs are arranged on the inner surface of the guide member to extend in an axial direction of the developer carrier and to protrude in a direction crossing a direction in which the current of air flows.

5. The image forming unit according to claim 4, wherein the ribs have gradually higher heights from one on an upstream side to one on a downstream side in a direction in which the current of air flows.

6. The image forming unit according to claim 5, wherein the image forming unit is an assembly integrally attachable to and removable from an image forming apparatus body, and a handle held for attachment or removal of the assembly is disposed at a position away from the image carrier and most upstream in a direction in which the recording medium is guided.

7. The image forming unit according to claim 4, wherein the image forming unit is an assembly integrally attachable to and removable from an image forming apparatus body, and a handle held for attachment or removal of the assembly is disposed at a position away from the image carrier and most upstream in a direction in which the recording medium is guided.

8. The image forming unit according to claim 3, wherein the image forming unit is an assembly integrally attachable to and removable from an image forming apparatus body, and a handle held for attachment or removal of the assembly is disposed at a position away from the image carrier and most upstream in a direction in which the recording medium is guided.

9. The image forming unit according to claim 2, wherein a plurality of ribs are arranged on the inner surface of the guide member to extend in an axial direction of the developer carrier and to protrude in a direction crossing a direction in which the current of air flows.

10. The image forming unit according to claim 9, wherein the ribs have gradually higher heights from one on an upstream side to one on a downstream side in a direction in which the current of air flows.

11. The image forming unit according to claim 10, wherein the image forming unit is an assembly integrally attachable to and removable from an image forming apparatus body, and a handle held for attachment or removal of the assembly is disposed at a position away from the image carrier and most upstream in a direction in which the recording medium is guided.

12. The image forming unit according to claim 9, wherein the image forming unit is an assembly integrally attachable to and removable from an image forming apparatus body, and a handle held for attachment or removal of the assembly is disposed at a position away from the image carrier and most upstream in a direction in which the recording medium is guided.

13. The image forming unit according to claim 2, wherein the image forming unit is an assembly integrally attachable to and removable from an image forming apparatus body, and a handle held for attachment or removal of the assembly is disposed at a position away from the image carrier and most upstream in a direction in which the recording medium is guided.

14. The image forming unit according to Claim 2, wherein a developer detection member is disposed on an area of an outer surface sealed with the film member and in which the agitation path of the development housing is disposed.

15. The image forming unit according to claim 1, wherein a plurality of ribs are arranged on the inner surface of the guide member to extend in an axial direction of the developer carrier and to protrude in a direction crossing a direction in which the current of air flows.

16. The image forming unit according to claim 15, wherein the ribs have gradually higher heights from one on an upstream side to one on a downstream side in a direction in which the current of air flows.

17. The image forming unit according to claim 16, wherein the image forming unit is an assembly integrally attachable to and removable from an image forming apparatus body, and a handle held for attachment or removal of the assembly is disposed at a position away from the image carrier and most upstream in a direction in which the recording medium is guided.

18. The image forming unit according to claim 15, wherein the image forming unit is an assembly integrally attachable to and removable from an image forming apparatus body, and a handle held for attachment or removal of the assembly is disposed at a position away from the image carrier and most upstream in a direction in which the recording medium is guided.

19. The image forming unit according to claim 1, wherein the image forming unit is an assembly integrally attachable to and removable from an image forming apparatus body, and a handle held for attachment or removal of the assembly is disposed at a position away from the image carrier and most upstream in a direction in which the recording medium is guided.

20. An image forming apparatus, comprising:

the image forming unit according to claim 1;

a transfer member that transfers a toner image on the image carrier of the image forming unit to a recording medium; and a fixing member that fixes the toner image transferred to the recording medium onto the recording medium.

* * * * *